United States Patent [19]

Groh

[11] Patent Number: 5,050,766

[45] Date of Patent: Sep. 24, 1991

[54] COLLAPSIBLE ICE CHEST

[76] Inventor: Gregory I. Groh, 387 Plaza Blvd., Pennsbury Ct. Apts., Apt. 121, Morrisville, Pa. 19067

[21] Appl. No.: 488,592

[22] Filed: Mar. 5, 1990

[51] Int. Cl.[5] ..... B65D 30/04

[52] U.S. Cl. ..... 220/412; 220/410; 229/2.1; 229/125.01; 229/DIG. 3

[58] Field of Search ..... 220/410, 411, 412, 413; 229/3.1, DIG. 3, 101, 117.07, 125.01, 23 NT

[56] References Cited

U.S. PATENT DOCUMENTS

| | | | |
|---|---|---|---|
| 918,601 | 4/1909 | Schurmann | 229/125.01 |
| 3,131,848 | 5/1964 | Floyd | 229/3.1 |
| 3,155,304 | 11/1964 | Beerend | 229/3.1 |
| 3,303,986 | 2/1967 | Tanaka | 229/125.01 |
| 3,465,948 | 9/1969 | Boyer | 220/410 |

FOREIGN PATENT DOCUMENTS

| | | | |
|---|---|---|---|
| 1364053 | 8/1974 | United Kingdom | 220/410 |

*Primary Examiner*—Joseph Man-Fu Moy

*Attorney, Agent, or Firm*—Gifford, Groh, Sprinkle, Patmore & Anderson

[57] ABSTRACT

A collapsible ice chest formed of a sheet of material such as corrugated paper to form a box-like structure, the bottom of which forms an ice tray to receive ice. The upper portions of the box-like structure fold over the ice tray portion to place it in a partially collapsed condition in which it can be stored in a cool atmosphere ready for use. The partially collapsed box-like structure can be unfolded to form an ice chest which is already loaded with ice and which can be covered with a lid to store materials to be cooled.

14 Claims, 2 Drawing Sheets

COLLAPSIBLE ICE CHEST

This invention relates to containers and more particularly to the collapsible coolers or ice chest for containing a coolant and being usable to keep substances within the ice chest at a reduced temperature.

A variety of ice chests are available, all requiring loading with a cooling medium such as ice and as a consequence requiring separate sources for the ice chests and for the ice to place in the chest. Moreover, such ice chests require cleansing and storage until next use.

There is a need for an ice chest which is available ready for use complete with the coolant or ice already loaded within the chest, all from a single source. Moreover, while there is a need for an ice chest which is sufficiently low in cost so that a single use can be justified, still an additional requirement is for an ice chest which can be disposed of and destroyed without creating ecological problems such as those encountered with molded heated foam containers presently in common use.

It therefore is an object of the invention to provide a collapsible ice chest meeting these needs. The objects of the invention are attained by a collapsible ice chest which is made of a rectangular blank of corrugated paper having a rectilinear bottom panel and pairs of side panels and end panels which are joined together at the four corners by gusset panels. All of the panels are separated from each other by imperforate fold lines, such that the gusset panels are foldable against the exterior of the adjoining end panels upon upward folding of the side and end panels relative to the bottom panel to form a leak proof, open top, box-like chest which can be closed by a separate box-type lid. Additional fold lines are formed in parallel space relation to the bottom panel and serve to divide the end and side panels into upper and lower panel portions such that the upper panel portions can be folded inwardly to cover an ice tray portion formed in the bottom of the chest by the bottom panel and the lower portions of the side and end panels. The ice tray portion can be filled with ice prior to folding the upper panel portions to cover the ice tray portion. The entire assembly, made up by the ice filled tray covered by the folded upper panel portions, can be covered by a box-like lid and stored in a cooled atmosphere until time for use. At that time, the cover can be removed and the upper side and end panels can be folded upwardly to form an open chest with space above the ice tray portion being available for storage of the materials to be kept at a reduced temperature. The open top chest can then be covered and maintained in a closed position by the box-like lid or cover.

A preferred embodiment of the invention is described by reference to the following drawings in which.

Figure 1:
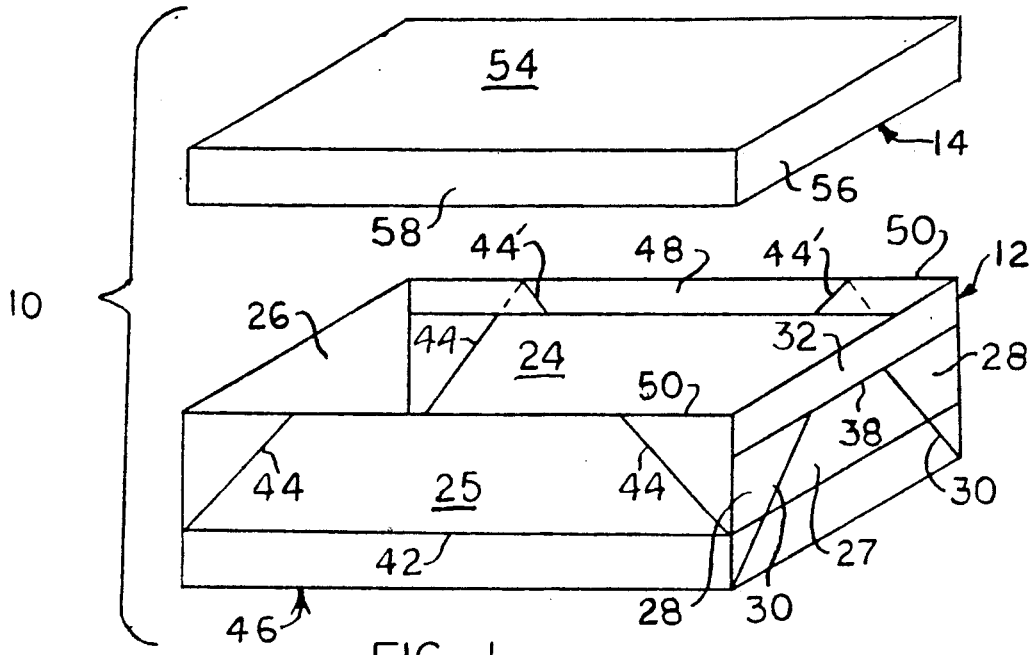
FIG. 1 is a exploded perspective view of the ice chest and lid embodying the present invention.

Referring to the drawings and particularly to FIG. 1, an embodiment of the invention is in the form of a collapsible cooler 10 having a box-like ice chest portion 12 and a box-like cover or lid 14 adapted to telescope over the top of the ice chest 12 to close the open end.

The ice chest 12 forming the bottom of the cooler 10 is formed from a flat blank 16 of corrugated double-backed paper.

Preferably, the material used is known in the industry as C-flute. If desired, backing or layer forming the inside of the ice chest 12 can be coated to inhibit water absorbtion. Such material has some inherent insulating characteristics because of the dead air spaces formed by the fluted paper between the inner and outer backing.

Figure 4:
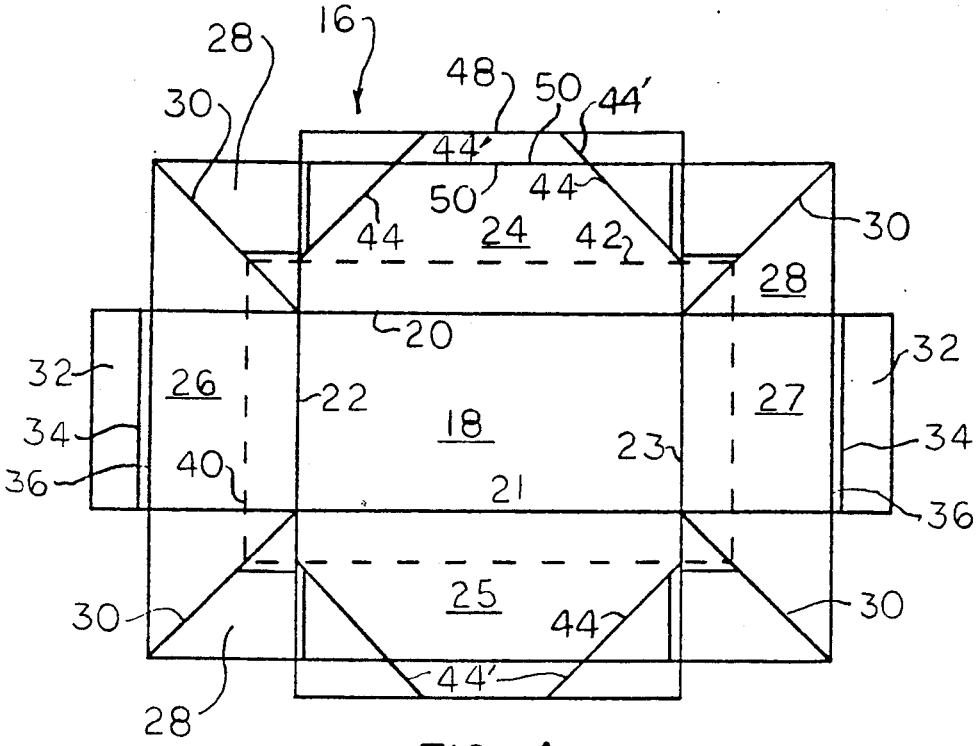
FIG. 4 is a plan view of the flat panel from which the ice chest is formed.

As seen in FIG. 4, the blank 16 is made of a single sheet and forms a bottom panel 18 of generally rectangular configuration and is defined by side fold or score lines 20 and 21 and by end fold or score lines 22 and 23. The fold lines 20 through 23 separate the bottom panel 18 from attached side panels 24 and 25 and end panels 26 and 27. Gusset panels 28 are formed at the four corners of the bottom panel 18 to join the side panels 24, 25 and end panels 26, 27. Each of the gusset panels is formed with a diagonal fold or score line 30. Upon folding the side panels 24, 25 and end panels 26, 27 upwardly, the gusset panels 28 fold along their respective fold or score lines 30 to permit the adjoining ends of the side and end panels to come into close adjacent relationship to each other. For example, the extension of the score line 23 forming the end of the panel 24 and the extension of the score line 20 forming the end of the end panel 27 are brought into adjacent relationship to each other with the gusset panel 28 folded along the score line 30 and along the lines 20 and 23 to be at the exterior of the corner of the ice chest 12. All four corners are formed in a similar manner and the result is a closed, leak proof box construction without any slits or openings.

Each of the end panels 26 and 27 is provided with a panel or glue tab 32. The glue tab 32 is separated from the panels 26 and 27 by closely spaced fold lines 34 and 36, which are spaced apart a sufficient distance to accommodate the thickness of the end panels 26, 27 and the folded gussets 28 as best seen in FIG. 1. When the ice chest 12 is formed into an open top box, the glue tabs 32 are disposed at the exterior of the box 12, and serve to form hand grip areas one of which is indicated at 38 in FIG. 1 by which the cooler 10 can be transported.

Each of the end panels 26 and 27, and side panels 24 and 25, are provided with a fold or score line 40 and 42, respectively, which serves to divide panels 24 through 27 into upper and lower panel portions. The fold lines 40 and 42 extend into each of the gussets 28 and intersect with each other in the area of the gusset fold lines 30. The fold lines 40 and 42 act together with diagonal fold lines 44 formed in the upper portions of the side panels 24 and 25 to permit collapsing of the upper panel portions of the ends 26, 27 and sides 24, 25 to close a box-like tray 46 formed at the bottom of the ice chest 12. The tray 46 may be considered as formed of the bottom panel 18 and the lower portions of the side panels 24, 25 and bottom portions of end panels 26, 27. Tray portion 46 formed in this manner is closed by the remaining upper portion of the ice chest, namely the upper portions of the panels 24 through 27.

When the ice tray portion 46 is uncovered to form the open ice chest portion 12 seen in FIG. 1, side panels 24 and 25 are reinforced by lock panels 48 which are separated from the side panels 24 and 25 by a fold line 50, seen also in FIG. 4. The fold lines 50 form the top edges of the open ice chest 12 seen in FIG. 1. The lock panels 48 are folded inwardly into the box-like ice chest 12 and prevent the side panels from collapsing along the diagonal fold lines 44. As best seen in FIG. 1, the portion of the diagonal fold line 44 formed in the lock panels 48 and designated 44*a*, act in opposition to the remainder of the fold line 44 and prevent collapsing of the side panels 24 and 25 about the fold lines 42.

Figure 2:
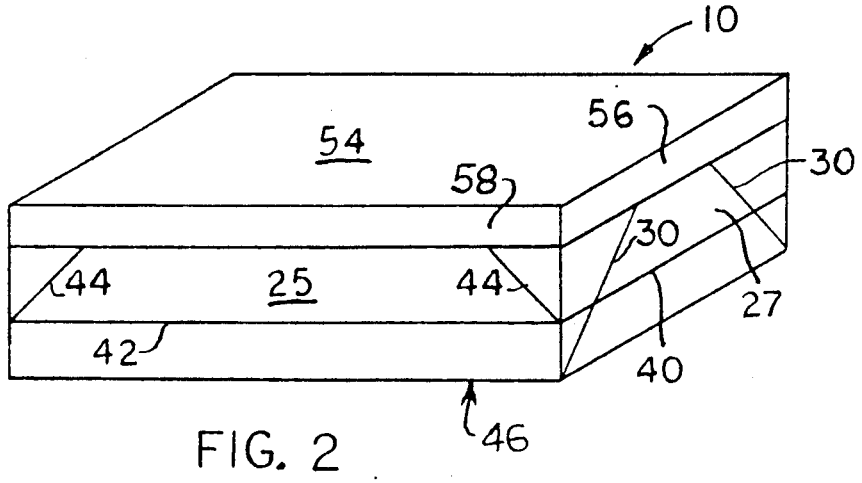
FIG. 2 is a perspective view of the ice chest in FIG. 1 in a closed position.
Figure 3:
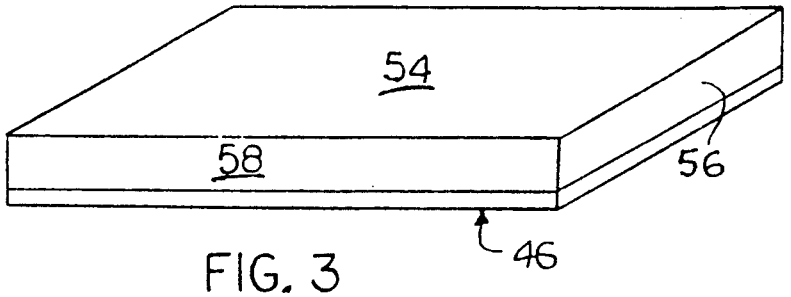
FIG. 3 is a perspective view of the ice chest in a closed collapsed condition in which it can be stored in a cool atmosphere ready for use.
Figure 5:
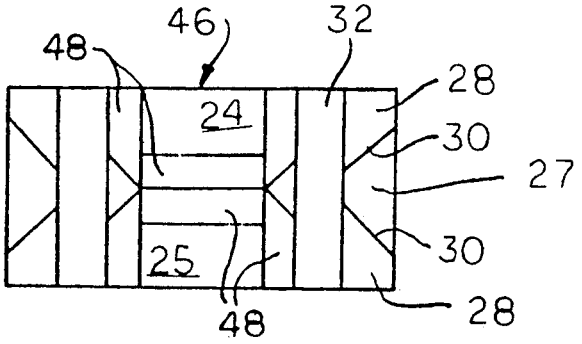
FIG. 5 is a top plan view of the bottom, cooler portion of the ice chest as seen in FIG. 3, but with the lid removed.

When the ice chest 12 is in its open condition as shown in FIG. 1, or when it is its closed tray position illustrated in FIGS. 3 and 5, the ice chest chest 12 can be covered by a lid assembly 52 having a top panel 54 and opposite end lips 56 and side lips 58 forming an inverted box-like structure which will fit over the ice chest 12 when it is in either its open position or in its tray forming condition as shown in FIGS. 2 and 3, respectively.

In commercial use, cooler 10 can be shipped in flat blank form and assembled at the site where the cooler is to be sold in its assembled condition and loaded with ice. The blank 16 can be folded to form the open box-like ice chest 12 and the bottom tray 46 can be loaded with ice. Such ice can be in the form of crushed ice or cubes, and if desired can be contained in a sealed, waterproof bag allowing the ice to conform to the shape of the tray portion 46. Thereafter, the upper panel portions can be folded inwardly along the fold lines 40 and 42 to close the loaded ice tray portion 46. The box-like lid 14 can be positioned over the closed tray 46 and the resultant collapsible compact unit can be stored in a cold location to preserve the ice.

The consumer receives the covered ice tray 46 as it is seen in FIG. 3. The consumer uses the cooler 10 by removing the lid 14 from the covered tray portion 46. The upper panels are folded upwardly to form an open-top box structure and the lock panels 48 are folded into the open box to reinforce the side panels 24 and 25. The ice chest 12 is ready for use by adding the materials to be kept at a lowered temperature and the box-like lid 14 is place over the open ice chest 12 to maintain the cold atmosphere within.

After the cooler 10 has been used, it can be disposed of by discarding it. Since it is made of paper, it can be burned or recycled. However, if the consumer desires, the cooler can be reused by emptying the ice chest portion 12. Unfolding the lock panels 48 upwardly will permit the side panels 24 and 25 to be folded inwardly to close the box-tray portion 46 which thereafter can be covered with the cover 14 as seen in FIG. 3 and placed in a storage location.

A collapsible ice chest has been provided in the form of a generally rectangular paper blank which can be formed into a leak proof ice chest, preloaded with coolant such as ice and stored in a partially collapsed condition ready for use. At the time of use, the collapsed arrangement can be unfolded to form an ice chest which can be covered to store materials to be cooled. The cooler is made of relatively cheap corrugated paper material and can be discarded after a single use or can be collapsed for storage for reuse.

I claim:

1. A collapsible cooler formed of sheet material and comprising:

a box-like structure having a bottom panel and opposed side and end panels joined together to form an open top, leakproof structure, fold lines formed in said side and end panels in parallel spaced relationship to said bottom panel, said fold lines defining the top edge of an ice tray portion, said side panels and end panels being foldable along said fold lines with portions above said fold lines folded toward each other to cover said tray portion and form a collapsed box-like structure, and a lid forming a cover telescopically fitting over said collapsed box-like structure or over said open top, leak-proof structure.

2. The combination of claim 1 in which said ice tray portion of said cooler contains ice when said cooler is in its collapsed, box-like condition.

3. The combination of claim 1 wherein said box-like structure is made of corrugated paper.

4. The combination of claim 1 wherein said box-like structure has its interior lined with water-proof material.

5. A collapsible ice chest comprising:

a generally rectangular blank having a rectilinear bottom panel, a pair of side panels and a pair of end panels, and gusset panels at the corners of said bottom panel and between adjacent end and side panels, said panels being separated from each other by imperforate fold lines, said gusset panels being foldable upon upward folding of said side and end panels relative to said bottom panel to form a leak-proof, open top, box-like chest, auxiliary fold lines formed in each of said end and side panels in parallel spaced relation to said bottom panel to divide said end and side panels into upper and lower panel portions, said upper panel portions being foldable inwardly to cover an ice tray portion formed in the bottom of said chest by said bottom portions of said panels and said lower panel portion, and a lid for said covered ice tray, said lid being removable to permit unfolding of said upper panel portions to form said open top chest, said lid being positionable on said open top chest to form a closed ice chest.

6. The combination of claim 5 in which said ice tray is filled with ice before said upper portions of said side and end panels are folded inwardly to close said ice tray.

7. The combination of claim 5 wherein said lid has a top panel and adjoining side and end panels forming an inverted box-like structure to cover said closed ice tray and open ice chest.

8. The combination of claim 5 wherein said gusset panels are each divided by a fold line extending from the corner of the bottom panel to permit folding of said gusset panels into substantially equal portions.

9. The combination of claim 8 wherein said gusset panels are foldable against the exterior of said end wall when said end walls and side walls extend perpendicular to said bottom panel.

10. The combination of claim 5 and further comprising tabs extending the full length of each of said end panels and being foldable over the exterior of the end wall panels to form a handle for lifting said ice chest.

11. The combination of claim 5 further comprising fold lines in the upper portions of said side panels extending diagonally from said auxiliary fold lines at each corner of said chest to permit inward folding of said end and side panels to cover said ice tray.

12. The combination of claim 11 and further comprising lock tabs extending the full length of said side panels and being foldable into said open top box structure to reinforce said upper edges of said side panels.

13. The combination of claim 5 wherein said box-like structure is made of corrugated paper.

14. The combination of claim 5 wherein said box-like structure has its interior lined with water-proof material.

* * * * *